United States Patent [19]

Hopke

[11] 4,269,539

[45] May 26, 1981

[54] METHOD FOR PREVENTING DAMAGE TO A REFRIGERATED GAS PIPELINE DUE TO EXCESSIVE FROST HEAVING

[75] Inventor: Scott W. Hopke, Stafford, Tex.

[73] Assignee: Exxon Production Research Company, Houston, Tex.

[21] Appl. No.: 967,556

[22] Filed: Dec. 7, 1978

[51] Int. Cl.[3] ..... E02D 19/14; F16L 1/02

[52] U.S. Cl. ..... 405/130; 165/45; 405/157

[58] Field of Search ..... 405/56, 130, 131, 157, 405/217; 62/260, 45, 55; 165/45

[56] References Cited

U.S. PATENT DOCUMENTS

| | | | |
|---|---|---|---|
| 3,217,791 | 11/1965 | Long | 165/45 |
| 3,564,862 | 2/1971 | Hashemi et al. | 405/131 X |
| 3,650,119 | 3/1972 | Sparling | 405/157 X |
| 3,859,800 | 1/1975 | Wuelpern | 405/130 |

*Primary Examiner*—David H. Corbin

*Attorney, Agent, or Firm*—Michael A. Nametz

[57] ABSTRACT

Heat pipes are installed in the soil directly beneath a buried refrigerated gas pipeline and operate continuously in conjunction with operation of the pipeline to beneficially alter the heat and water flow patterns thereby substantially preventing frost heaving without regard to the season.

19 Claims, 6 Drawing Figures

METHOD FOR PREVENTING DAMAGE TO A REFRIGERATED GAS PIPELINE DUE TO EXCESSIVE FROST HEAVING

BACKGROUND OF THE INVENTION

1. Field of the Invention

This invention relates to a method of preventing the deformation of a refrigerated gas pipeline which traverses frost-susceptible soil. In particular, the invention pertains to a method utilizing refrigerating-type heat pipes installed below the pipeline to remove heat from the soil without regard to seasonal temperature variations, thereby preventing excessive frost heaving of the pipeline.

2. Description of the Prior Art

Permafrost often has a high water content so that if it becomes thawed to any significant extent, it is unable to adequately support structures on or in it. Heat pipes have been used previously in connection with support piles for pipelines and other structures in order to stabilize the soil in arctic regions where permafrost is prevalent. For example, U.S. Pat. No. 3,859,800 (issued to L. E. Wuelpern on Jan. 14, 1975) teaches the use of piles passively refrigerated by heat pipes for permafrost stabilization of elevated pipelines, and U.S. Pat. No. 3,788,389 (issued to E. D. Waters on Jan. 29, 1974) shows the use of heat pipes for stabilizing soil surrounding structural supports (such as telephone poles).

A different problem exists with refrigerated gas pipelines used to transport arctic gas. These pipelines are refrigerated where they pass through permafrost in order to prevent thaw-settlement of the pipeline and to prevent soil erosion, icings, slope instability and other problems related to thawing permafrost. Also, there are economic incentives for chilling gases in the currently proposed large diameter, high pressure pipelines due to higher gas density, lower flowing pressure losses and lower compression costs at lower temperature. A discussion of refrigerated gas pipelines is given by G. King, "The How and Why of Cooling Arctic Gas Pipelines", Parts I and II, *Pipeline and Gas Journal* (September and October, 1977).

When these refrigerated pipelines traverse unfrozen ground or shallow permafrost where the soil is frost-susceptible, damage due to frost heaving is possible. Frost heaving can occur when water migrates toward the cold pipeline, collecting in layers of almost pure ice (ice lenses) beneath the pipeline. The resulting extra volume of ice causes soil deformation, usually in the form of heaving of the soil and pipeline above the lenses. The pipe may be heaved out of the ground in some cases. Moreover, the possibility of differential heave magnifies the threat to pipeline integrity. Differential heave occurs where the pipeline passes through adjacent soil zones that heave at different rates. For example, the pipeline may encounter a region of unfrozen frost-susceptible ground surrounded by permafrost. When this unfrozen ground freezes due to cooling by the pipeline, it will heave much more rapidly than the surrounding permafrost. The resulting differential heave can cause wrinkling and, ultimately, rupture of the pipeline.

Several methods have been proposed for dealing with the problem of frost heave of refrigerated gas pipelines, including replacing the frost-susceptible soil surrounding the pipeline with non-frost-susceptible soil and physically restraining the pipeline to prevent heave.

Another solution proposed in the prior art has been to heavily insulate the pipeline and/or heat the soil beneath the pipeline in order to prevent formation of the ice lenses. A discussion of the problems and current approaches for operating refrigerated gas pipelines in permafrost and unfrozen soil may be found in A. C. Matthews, "Natural Gas Pipeline Design and Construction in Permafrost and Discontinuous Permafrost", SPE 6873 (1977).

While these methods provide some measure of relief from the problems of frost heaving, there are serious difficulties associated with each. These methods generally will involve specialized construction techniques, as where the pipelines are coated with insulation material and where individual electric heaters are installed. Careful surveillance and frequent adjustments of heating rates are also required. Further, adequate methods for monitoring pipeline heave are not yet available. Finally, these specialized techniques and devices inherently involve very high, possibly prohibitive costs due to the great length of a pipeline system requiring frost heave protection. Hundreds of transitions from frozen to thawed ground may be encountered with any major arctic gas pipeline. For example, precautions will be taken to protect the Alaska Highway Gas Pipeline from frost heave over at least an 80 mile length using some of the proposed techniques outlined above; for details, see *Oilweek,* page 20 (Apr. 17, 1978).

Recently, an alternative method for reducing frost heave has been suggested in U.S. patent application Ser. No. 938,662 filed on Aug. 31, 1978, now Pat. No. 4,194,856. To avoid many of the problems mentioned above, heat pipes are installed in diametrically opposed pairs, one on either side of the pipeline, spaced along the length of pipeline traversing soil subject to frost-heave. Long vertical frost bulbs are formed due to the operation of the heat pipes. These frost bulbs create confining forces on the pipeline tending to reduce frost heave. However, while this method presents advantages over methods previously proposed, a disadvantage exists in that the operation of the heat pipes is seasonal in nature, heat transfer taking place only during the winter months when the ambient temperature is colder than the soil temperature. Moreover, this places limits on constructing and operating the refrigerated pipeline because there can be a time lag before the heat pipes can operate.

SUMMARY OF THE INVENTION

The present invention relates to a method of preventing damage to a refrigerated gas pipeline due to excessive frost heaving which utilizes relatively low cost heat pipes which operate in conjunction with the refrigerated pipeline itself to alleviate the above problems.

In accordance with this invention, heat pipes are installed by completely burying them in the soil directly beneath the pipeline. Since the refrigerated pipeline adjacent to the top of the heat pipes is colder than the surrounding ground, the heat pipes transfer heat from the ground well below the pipeline to soil near the bottom of the pipeline. When heat pipes are utilized in this fashion, frost bulbs are caused to grow under the pipeline in a series of vertical cylinders underneath the pipeline with increasing radii. Any ice lenses that form are vertical and therefore do not cause the pipeline to heave. Rather, the vertical lenses result in increased lateral confinement of the frozen ground and provide increased resistance to heave. By altering the pattern of heat and water flow, the supply of water available for lens formation near the pipe, and between heat pipes, is effectively reduced.

Heat pipes are installed after ditching and before pipeline laying. Significantly, operation of the heat pipes is not seasonally dependent and begins the moment the pipeline is started up.

The exact configuration of the heat pipes as installed beneath the pipeline is chosen to provide adequate heat transfer to the ground below the pipeline while minimizing heat transfer to the pipeline fluid itself, which could lead to excessive chilling expenses at the pump or compressor stations. A particularly preferred embodiment of the present invention employs a heat pipe which is bent to provide a nearly horizontal portion just under the pipeline. This provides good thermal coupling over a considerable length of the pipeline for each heat pipe.

While any passive heat extraction device can be used in the practice of this invention, the use of heat pipes is preferred since heat pipes are relatively low cost, highly efficient, and generally maintenance free, and do not require specialized construction techniques.

DESCRIPTION OF THE PREFERRED EMBODIMENT

Figure 1:
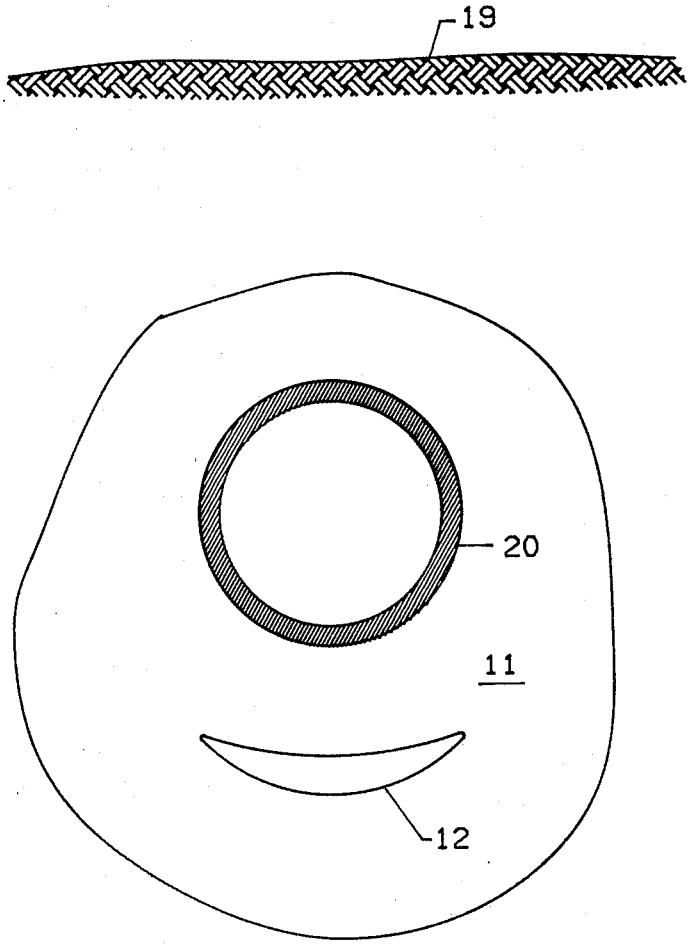
FIG. 1 is a schematic, cross sectional end view of a buried refrigerated gas pipeline without heat pipes installed according to the present invention.

FIG. 1 schematically depicts a buried refrigerated gas pipeline 20 surrounded by a frost bulb 11 having an oblong cross section and containing horizontal ice lens 12 exerting an upward force on the pipeline 20. Ice lens 12 is crescent shaped in cross section, but referred to herein as a horizontal lens to distinguish over vertical ice lenses that may form around heat pipes installed adjacent to pipeline 20. During operation of refrigerated gas pipeline 20, water tends to migrate through the soil and frost bulb 11 to a point beneath the pipeline where it freezes. Ice lens 12 forms beneath the pipeline simply because it is the coldest region of the temperature field around the pipeline. As more water migrates to this region, freezes and expands, the ice lens 12 thickens, exerting an upward pressure on pipeline 20. As it thickens, the ice lens 12 moves the soil and therefore pipeline 20 at a rate which depends on many factors, including the type of soil, the upward force distribution due to the thickening ice lens, the availability of water, and the overburden pressure. In some cases, the rate that ice lens 12 thickens, or the rate of frost heave, may be low enough so that pipeline deformation is inconsequential. Frequently, however, the rate of frost heave will be sufficiently high to cause serious problems in pipe deformation.

Figure 2:
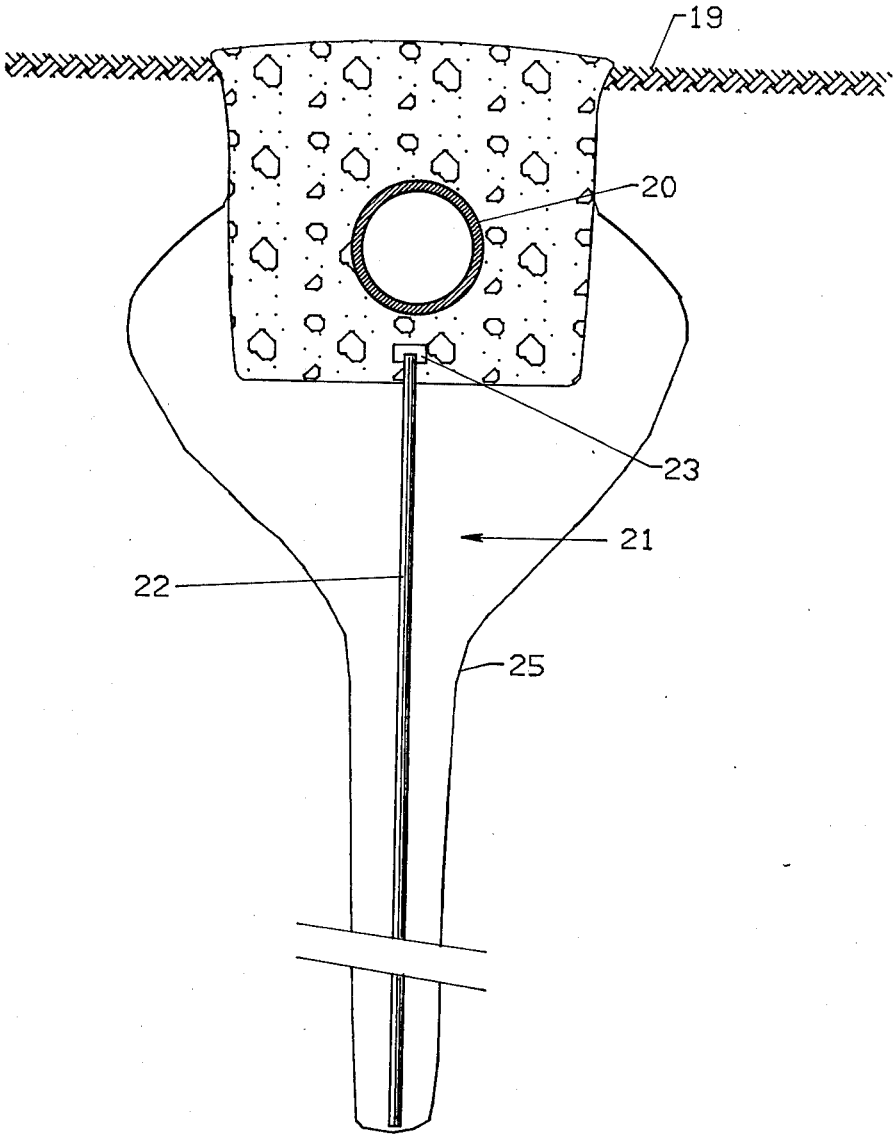
FIG. 2 is a schematic end view, in section, of a heat pipe installed beneath a buried refrigerated gas pipeline.
Figure 3:
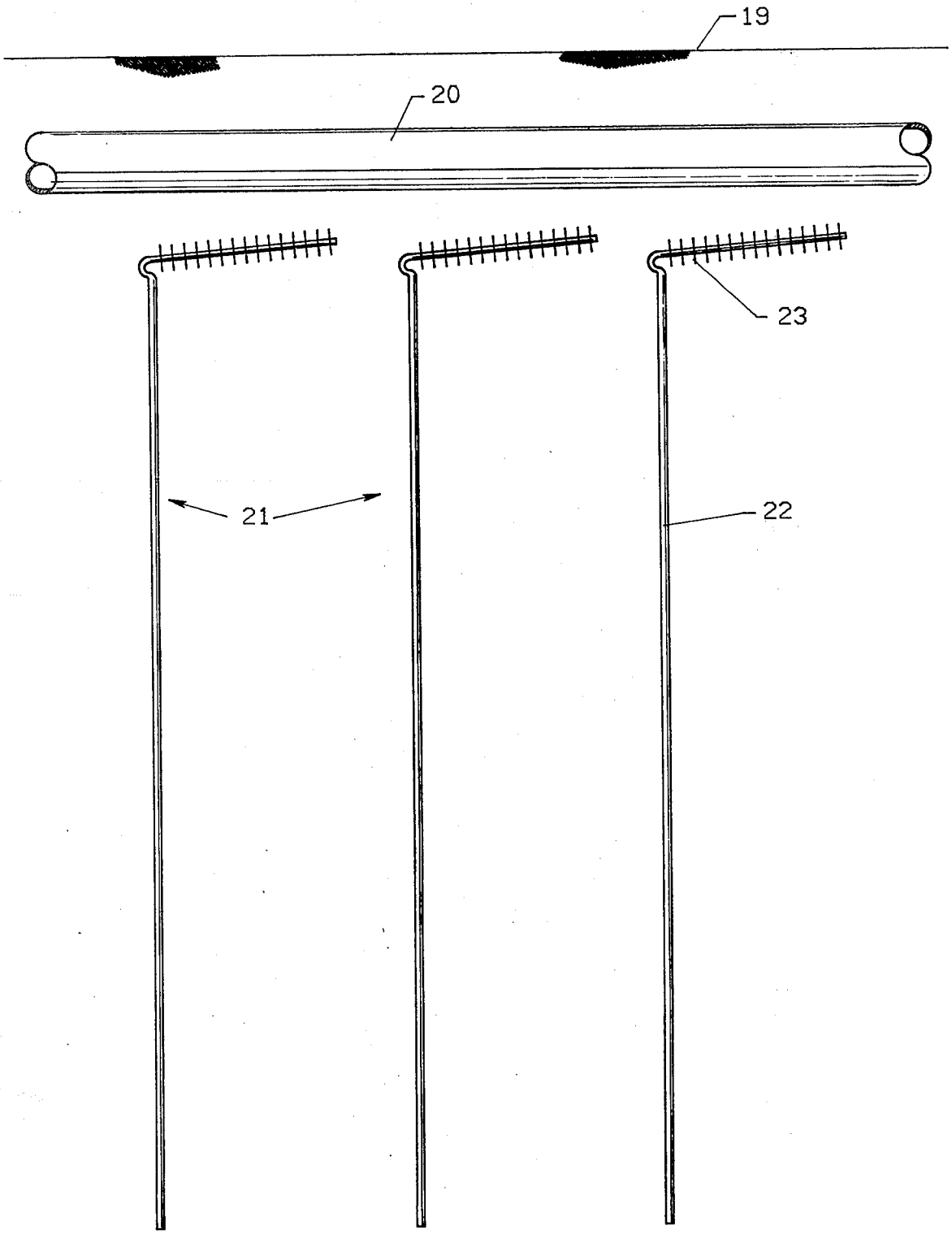
FIG. 3 is a schematic side view, partially in section, showing one manner of placing heat pipes beneath the pipeline.
Figure 4:
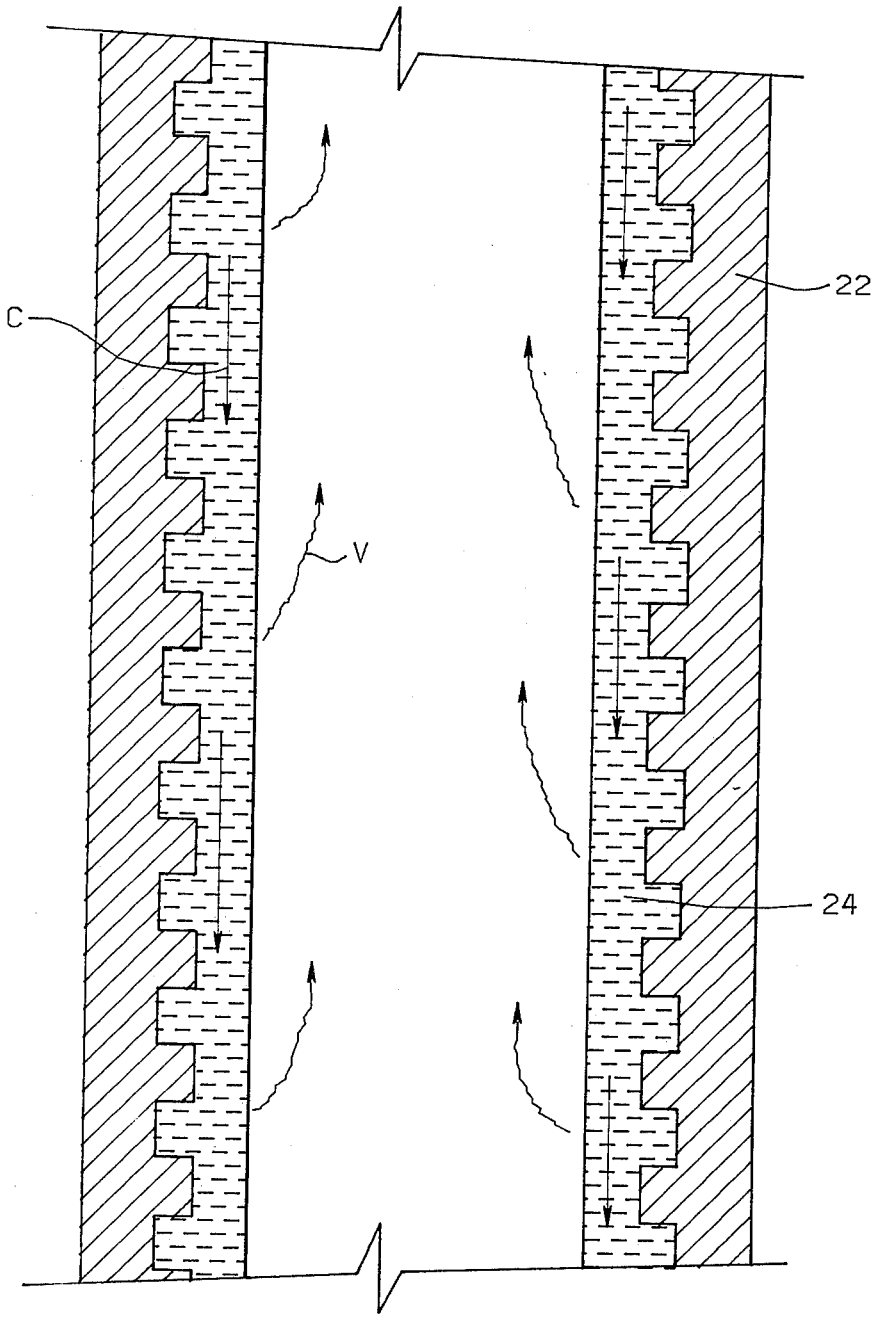
FIG. 4 is a schematic cross section of a heat pipe.

FIGS. 2 and 3 schematically illustrate the operation and effect of installing heat transfer devices, preferably heat pipes, directly beneath buried refrigerated gas pipeline 20. Typical heat pipe 21, a portion of which is shown in greater detail in FIG. 4, comprises a sealed tube 22, fitted with a radiator 23 at its upper end, and charge with a suitable refrigerant working fluid 24. As seen in FIG. 4, the inner surface of each sealed tube 22 is grooved or roughened in order to increase the surface area available for the evaporation/condensation process that takes place when the heat pipe is operating.

Suitable working fluids are characterized by a high latent heat of vaporization, high surface tension, low viscosity and, of course, an operating temperature range capable of freezing the soil. One specific suitable working fluid satisfying these requirements is ammonia; other suitable fluids will be readily apparent to those skilled in the art.

The heat pipe 21 is a natural convection, two-phase heat transfer loop which transfers heat by vaporization and condensation within a closed system. As a significant feature of the method of this invention, the heat pipe operates any time the temperature of cold pipeline 20 is less than that of the soil; in practice, this means that its operation will generally be continuous with pipeline operation. This is of great advantage since seasonal variations in temperature do not dictate construction or operation schedules.

In operation, heat from the soil enters the tube 22, causing the refrigerant 24 to boil. Vapor travels up the tube to the radiator 23 adjacent to refrigerated pipeline 20 where it condenses on the radiator's cool surface and releases thermal energy. FIG. 4 includes arrows illustrating the direction of vapor (V) and condensate (C) flow. The radiator 23, schematically depicted in FIG. 3, is utilized in order to promote efficient and rapid heat dissipation to the soil beneath pipeline 20. The condensed refrigerant 24 then flows down the sides of tube 22, and the cycle is repeated. When pipeline 20 and, hence, the heat pipe 21 is operating, heat from the soil is continuously transferred to the soil near the pipeline through the radiator 23. Heat pipe 21 will operate for as long as the soil temperature adjacent to any portion of the tube 22 is warmer than the temperature of the soil adjacent to the refrigerated gas pipeline 20. In practice, this will be the case in almost every instance so that effectively operation of the heat pipes to protect against frost heave is inherent with operation of the pipeline itself.

The exact placement of the heat pipes is chosen so that adequate heat transfer to the soil directly below the pipeline takes place, while at the same time heat transfer to the pipeline fluid itself is minimized. Thus, if heat pipes 21 are installed too close to the pipeline 20, excessive costs can occur because extra chilling of the transported gas is required at the pump or compressor stations; also, damage to the heat pipes could occur during pipelaying operations if the heat pipes will be too close. On the other hand, if the heat pipes are located too far below the pipeline, lensing sufficient to cause heaving may occur between the pipeline and heat pipe. The preferred distance of the top of heat pipe 21, actually radiator 23, from the bottom of refrigerated pipeline 20 will range between about 6 inches and about 18 inches, when pipeline 20 is operated at between about 10° and about 30° F. The maximum separation generally increases the colder the pipeline.

The design and construction techniques of suitable heat pipes for practicing the method described herein are well known. In general, however, suitable heat pipes will be capable of transferring heat from the soil to the surface with a temperature differential less than 0.5° F. Further details on heat pipes are provided in J. W. Galate, "Passive Refrigeration for Arctic Pile Supports", *Journal of Engineering for Industry,* Vol. 98, No. 2, p. 695 (May 1976). Specific suitable heat pipes for use in the present invention are described in a brochure entitled "Application of the Cryo-Anchor (TM) Stabilizer to Refrigerate Support Piles in Marginal Soils", McDonnell Douglas Astronautics Company Publication No. DWDL-721-063 (January 1972). This specific heat pipe has a claimed effective thermal conductivity of 140,000 Btu/hr ft°F. Other suitable heat pipe designs will be readily apparent to those skilled in the art.

Refrigerated gas pipeline 20 is a large diameter, high pressure refrigerated gas transmission line. In general, the top of the pipeline will be at least 30 inches below the surface. Pipeline diameters may range from 36 inches to 56 inches. The diameter of the pipeline together with te operating pressures will govern the gas throughput and the required capacity of the associated compressing and cooling facilities. Also, if proper attention is given to optimally locating the heat pipes below the pipeline (i.e. not too close to the pipeline), the effect of heat pipe operations (due to added heat transferred to the soil adjacent the pipeline on the capacity requirements of the associated refrigeration facilities) will be minimal.

The large diameter refrigerated pipelines which cooperate to provide the driving force for heat pipe operation are designed to operate at maximum pressures ranging from about 1000 to about 2100 psig. Combination cooling/compressor stations are located at intervals along the pipeline such that the gas can be maintained at a high pressure and at temperatures between about 10 and about 30° F., preferably from about 15° to about 25° F.

A detailed discussion of the design of one particular 48 inch diameter refrigerated gas pipeline and associated cooling/compressor facilities is given in the article by G. King, referred to above.

The method of the present invention alleviates the frost heaving problem which is associated with operating a refrigerated gas pipeline at the 10°–30° F. temperatures required for permafrost protection and efficient transportation of gas. In practicing the preferred embodiment, concurrently with or following ditching operations, boreholes for accommodating the heat pipes are drilled into the soil which will be beneath the pipeline when installed. The depth of the boreholes will be about 20–50 feet. Boreholes are spaced along the length to be protected from frost heave at up to approximately 50 foot intervals, preferably up to about 20 foot intervals, most preferably 8 to 12 foot intervals. The spacing of the boreholes along the length of the pipeline is in part governed by the desired merger rate of adjacent frost bulbs which form around the heat pipes 21; if spaced too far, unprotected lengths occur between heat pipes where lens can form capable of causing undesirable heaving. The spacing will depend also upon the specific heat pipe design and geometry, e.g. the spacing can be far apart where an efficient radiator design is used and the upper portion of the heat pipe is bent to provide a nearly horizontal portion.

Heat pipes 21 are then installed, preferably with radiators 23 extending nearly horizontally along the bottom of the ditch. The radiators 23 should not, of course, be absolutely level or horizontal because no drainage of refrigerant could occur. The ditch is then backfilled to provide abot 6 inches to about 18 inches of soil between the top of the radiator and the bottom of pipeline 20 when installed. As discussed previously, this ensures sufficient balance between heat pipe operational efficiency and undesirable heat transfer to the transported refrigerated gas in pipeline 20. Once this layer of soil has been placed, the pipeline 20 can be laid and the ditch filled according to techniques well known in the art. The pipeline is then ready to commence operation.

Significantly, once pipeline operation is initiated, regardless of the season, excessive frost heave is prevented since the heat pipes begin to function almost at once. Thus, so long as the temperature of the soil immediately surrounding cold pipeline 20 is less than the lower portion of heat pipe 21, frost bulbs 25 form around the heat pipe. Water tends to migrate not such that a horizontal ice lens 12 forms beneath pipeline 20, but migrates towards the heat pipes where vertical ice lenses can form. With continuous operation, adjacent frost bulbs 25 surrounding heat pipes 21 gradually merge together and frost heave problems are almost completely eliminated. The process will be quantitatively discussed later in the Example.

The benefits of this invention are due, in part, to the completely buried heat pipes operating together with the refrigerated pipeline in a synergistic fashion; the growth and merger of adjacent frost bulbs 25 effectively alleviates frost heave problems due to several factors. The primary effect of the heat pipes is to change the pattern of heat flow. Heat will preferentially flow to heat pipes 21; in essence, heat flows to precisely the location where damaging horizontal ice lenses would form. The different heat flow pattern, along with the change in water migration direction may completely eliminate lensing. Conceivably, the only ice lenses which will form will be vertical and would not impinge on the pipeline to cause deformation.

In addition, referring to FIG. 2, as the frost bulbs 25 around heat pipes 21 grow, the frost front below pipeline 20 is lowered. (The term "frost front" as used herein means the region below the pipeline having a temperature of 32° F., the freezing point of water.) This means that the depth of the region where water will freeze to form a horizontal ice lense is approximately equal to the relative depth the heat pipe is buried. A corresponding increase is overburden pressure occurs simply due to the greater depth of potential horizontal ice lens formation; the greater overburden pressure is better able to counteract any upward force which may exist. The rate of heaving decreases rapidly with increasing overburden.

Because the heat pipes 21 operate continuously in conjunction with refrigerated pipeline 20 operation, effectively a unitary, huge bulb of frozen soil is formed around the pipeline having tremendous mass. Even if horizontal lensing were to occur at the lower portion of such a frozen mass, such a large mass would resist significant dislocation. Further, frost heave protection inherently results with pipeline operation.

Another benefit of the present invention is that freeze-thaw cycles are greatly dampened. Such cycles occur due to fluctuations in pipeline operating conditions. It is known that freeze-thaw cycles can increase the amount of heave because the water content of the soil increases. The heat pipes increase the effective heat capacity of the soil thereby limiting movement of the freeze front.

EXAMPLE

The benefits of this invention are achieved because heat pipes which are completely buried beneath the pipeline operate together with pipeline operation synergistically to reduce the frost heaving rate. Thus, the direction of water migration is altered; the permeability of the soil to water flow is lowered; the freeze front is lowered to greater depths beneath the pipeline; and higher overburden pressures act to reduce heaving. Importantly, heat pipe operation is not seasonal but is generally continuous so long as the pipeline is colder than the surrounding soil.

Approximate two-dimensional thermal analysis of the heat pipe configuration disclosed herein was performed in order to estimate frost bulb growth rates and geometry.

The configuration considered consisted of a row of heat pipes 21 completely buried beneath the centerline of pipeline 20 as schematically depicted in FIG. 3 and generally discussed previously. To simplify mathematical analysis, the heat pipes are estimated to provide a one foot wide continuous region of high thermal conductivity beneath the pipeline. However, the thermal conductivities used in the model (1000 Btu/hr ft°F.) were conservative when compared to the claimed effective thermal conductivities of typical heat pipes (eg., 140,000 Btu/hr ft°F. for the Cryo-Anchor (TM)). The heat pipes were modelled to be buried to a 20 foot depth, and the top one foot below the bottom of the pipeline.

Analysis of the performance of the heat pipes was determined through the use of a computer program which simulates the behavior of heat pipes. The particulars of the computer program are not presented herein. Additional details on the programming approach are given in J. A. Wheeler, "Simulation of Heat Transfer from a Warm Pipeline Buried in Permafrost", presented at the Seventy-Fourth National Meeting of AIChE, New Orleans, Mar. 11–15, 1973; another example of the smulation techniques used can be found in the J. W. Galate reference cited above. One skilled in the art, given the references presented above, could construct a program for duplicating the results presented herein.

As stated, heat pipe operation was modeled by a region of high thermal conductivity along and beneath the length of the pipeline. The input parameters to the simulator are summarized below:

Soil Properties

A fine silt
Initial ambient temperature of 35° F.
Heat capacities of 40 BTU/ft$^3$ (thawed soil) and 27 BTU/ft$^3$ (frozen soil)
Thermal conductivities of 0.8 BTU/hr ft°F. (frozen soil) and 1.2 BTU/hr ft°F. (frozen soil)
Heat of fusion equal to 3700 BTU/ft$^3$

Pipeline 48 inch outside diameter
Wall temperature of 25° F. when operating

Heat Pipes 2.5 inch outside diameter
Buried to a depth of 20 feet. The top of the heat pipes buried 12 inches below bottom of pipeline.
Continuous line beneath pipeline.
Thermal condutivities of up to 1000 BTU/hr ft°F.

Since operation of heat pipes is essentially season-independent, climatological considerations were necessary only to determine the growth of frost bulbs without heat pipe protection. The climate of Fairbanks, Ak. was used for this purpose.

Figure 5:
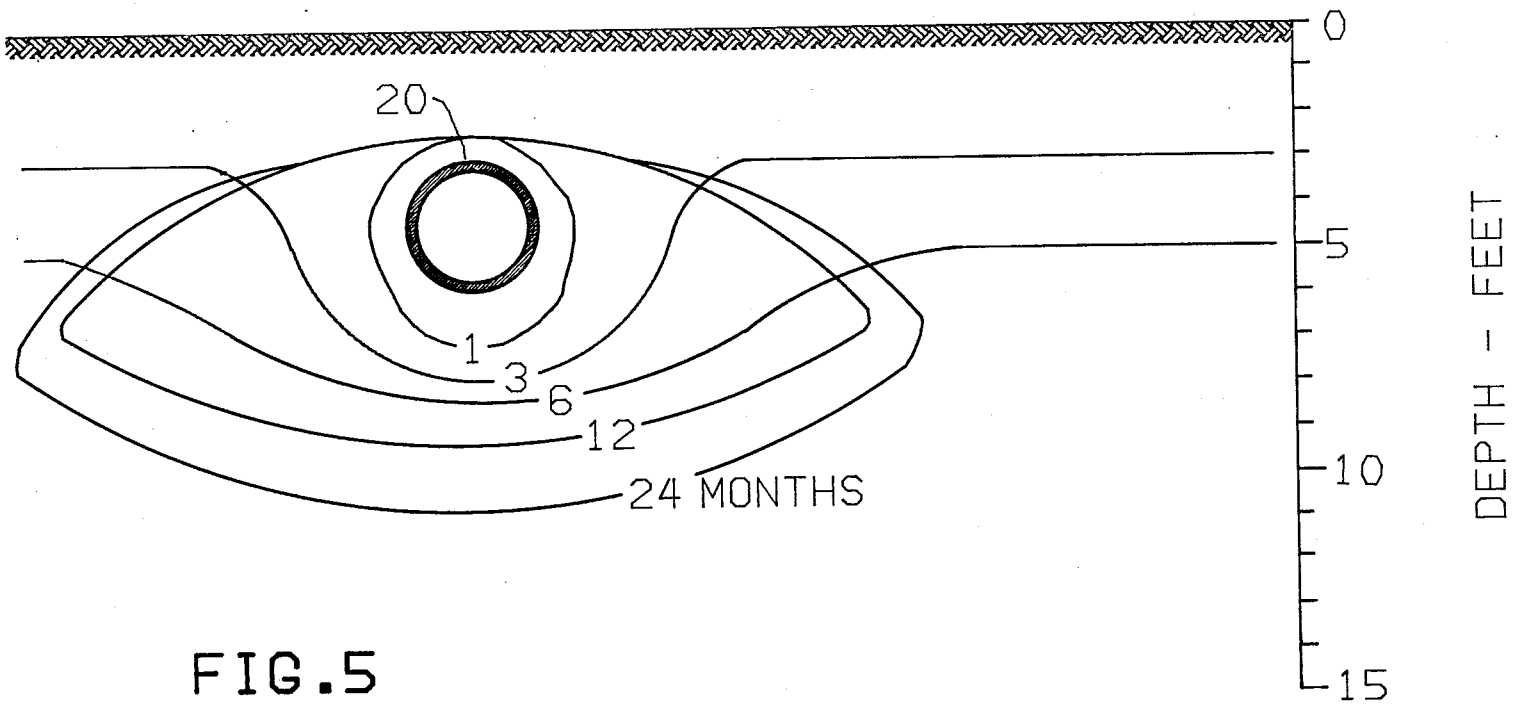
FIG. 5 is a schematic side view, in section, showing the frost bulb growth around a 25°F. pipeline without heat pipe protection.

Initially, as a basis for comparison, the frost bulb growth around the pipeline 20 with no heat pipe protection was determined and is depicted schematically in FIG. 5. The calculated frost penetrations of 5 feet below the pipeline in the first year and an additional 2 feet in the second year are in good agreement with data obtained by Northern Engineering Services Limited at their Calgary (Canada) test site. For this experimental data see W. A. Slusarchuk, et al., "Field Test Results of a Chilled Pipeline Buried in Unfrozen Ground", *Proceedings of the Third International Conference on Permafrost,* sponsored by the National Research Council of Canada, Vol. 1, pp. 877–883 (July 10–12, 1978). This paper also discusses some of the conventional monitoring and protective schemes aimed at mitigating frost heave.

Figure 6:
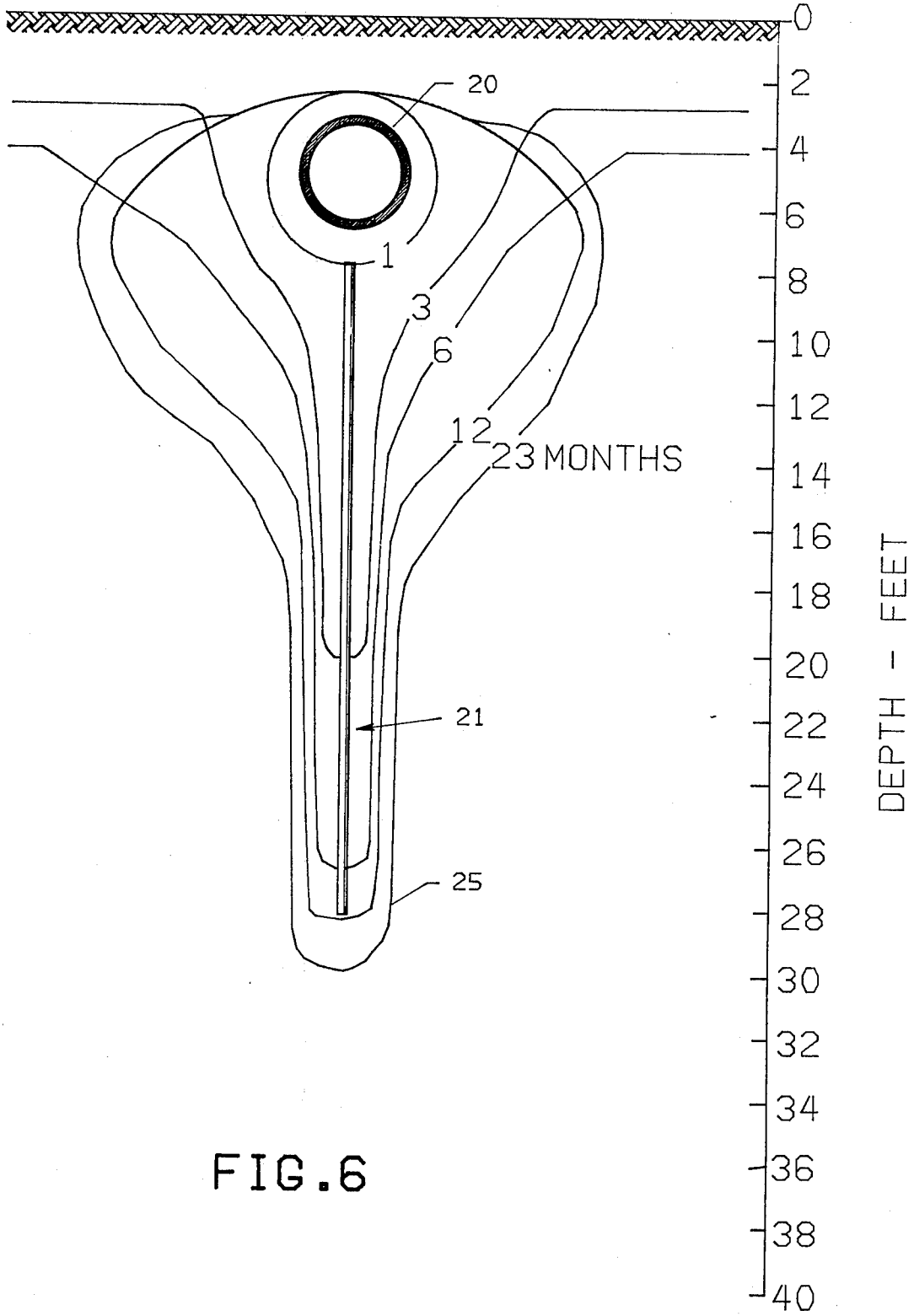
FIG. 6 is a schematic end view, in section, showing frost bulb growth in a vertical plane perpendicular to the pipeline and containing a heat pipe.

Next, frost bulb growth resulting from completely buried heat pipes were calculated. As shown in FIG. 6, the frost bulb grows rapidly below the pipeline 20, and frost heave protection is extremely rapid with pipeline startup. Within 3 months, a long "spiked" frost bulb has formed with any significant lensing near the pipeline being vertical in nature. Horizontal lensing is restricted after 12 months to below the bottom of the heat pipes, which is harmless. Significantly, the essential shape of the bulb remains the same and seasonal variations in temperature do not affect heat pipe operation. Thus, protective frost bulb growth is rapid, continuous, and begins very soon after pipeline startup. For this case, frost bulb formation takes place after about one month of operation.

These simulations of frost bulb growth rate and geometry clearly indicate that the frost heave problem is substantially reduce within three months after pipeline startup. The rate that horizontal lenses can grow is greatly reduced because most of the heat removed by the pipeline is supplied by the heat pipes. The soil below the pipeline is completely frozen to form a large, combined frost bulb around the pipeline which provides substantially complete protection against differential heave. Heaving rates which are less than about 0.01 ft/yr are assured after the frost bulbs merge.

The method of the invention and the best mode contemplated for applying that method have been described. It should be understood that the foregoing is illustrative only and that other means and obvious modifications can be employed without departing from the true scope of the invention defined in the following claims.

What I claim is:

1. A method of preventing the deformation of a refrigerated gas pipeline buried in frost-susceptible soil due to frost-heaving from ice lenses beneath said pipeline which comprises:

(a) installing heat pipes in the soil beneath said pipeline such that a temperature differential will exist between said pipeline and the soil surrounding a lower portion of said heat pipes during pipeline operation; and (b) flowing a refrigerated gas through said pipeline such that said heat pipes operate in conjunction with operation of said refrigerated gas pipeline due to said temperature differential to freeze the soil without forming ice lenses capable of heaving said pipeline.

2. The method of claim 1 which includes installing said heat pipes within about 6 to about 18 inches from the bottom of said pipeline.

3. The method of claim 1 which includes extending an upper portion of each of said heat pipes nearly horizontally beneath said pipeline.

4. The method of claim 1 which includes installing said heat pipes such that adequate heat transfer is achieved to the soil adjacent to the upper portion of said heat pipes, while mnimizing heat transfer to the refrigerated gas contained in said pipeline.

5. The method of claim 1 wherein said pipeline is operated at between about 10° F. and about 30° F.

6. A method of installing and operating a pipeline for transporting refrigerated fluids in frost-susceptible soil so that frost heaving is alleviated during operation of said pipeline, which comprises:

(a) forming a ditch in said soil for burying said pipeline;

(b) installing heat pipes in the bottom of said ditch such that a temperature differential will exist between said pipeline and the soil surrounding a lower portion of said heat pipes during pipeline operation, said heat pipes extending subtantially downwardly beneath the bottom of said ditch and, due to said temperature differential, operating to passively extract heat from the soil when refrigerated fluid flows through said pipeline;

(c) partially filling said ditch with soil to provide a layer of soil above said heat pipes;

(d) installing said pipeline in said ditch above said heat pipes;

(e) filling said ditch with soil to bury said pipeline; and (f) flowing a refrigerated fluid through said pipeline such that said temperature differential is created.

7. The method of claim 6 wherein the amount of soil provided in step (c) is chosen so that adequate heat is transferred to the soil directly beneath said pipeline during operation of said heat pipes, while at the same time heat transferred to the pipeline fluid itself is minimized.

8. The method of claim 7 wherein the depth of said layer of soil ranges from about 6 inches to about 18 inches, when said pipeline is to be operated at from about 10° to about 30° F.

9. A method of substantially preventing the frost heaving of a refrigerated gas pipeline buried in frost-susceptible soil due to the upward force of horizontal ice lenses forming beneath said pipeline which comprises:

(a) installing a plurality of heat pipes substantially along the axis of said pipeline and in the soil beneath said pipeline such that a temperature differential will exist between said pipeline and the soil surrounding a lower portion of each of said heat pipes during pipeline operation; and (b) flowing a refrigerated gas through said pipeline such that said heat pipes operate to remove heat from the soil when said pipeline is in operation whereby the direction of heat flow and water migration is altered so as to prevent formation of said horizontal ice lenses.

10. The method of claim 9 which includes fitting an upper portion of each of said heat pipes with a radiator to facilitate heat transfer.

11. The method of claim 10 which includes extending said upper portion nearly horizontally beneath said pipeline.

12. The method of claim 11 which includes extending each of said heat pipes from about 20 to about 50 feet below said pipeline.

13. The method of claim 12 which includes separating said lower portions of said heat pipes by up to about 50 foot intervals.

14. A method for reducing frost heaving of a refrigerated gas pipeline buried in frost-susceptible soil which comprises:

installing in said soil a plurality of heat pipes along the axis of said pipeline during ditching operations, a portion of each of said heat pipes extending downwardly into said soil a substantial distance and another portion thereof extending nearly horizontally beneath said pipeline, and flowing refrigerated gas through said pipeline such that a temperature differential is created between said pipeline and the soil surrounding said downwardly extending portions of said heat pipes sufficient to cause said heat pipes to extract heat from the soil to form a massive frost bulb in the soil adjacent to said heat pipes tending to resist significant dislocation due to frost heaving.

15. The method of claim 14 wherein a layer of soil between about 6 inches and about 18 inches thick is provided between said nearly horizontally extending portions of said heat pipes and said pipeline.

16. The method of claim 14 wherein the rate of frost heaving is reduced to less than about 0.01 ft/yr.

17. The method of claim 14 wherein said frost bulb begins to form within about one month after pipeline startup, regardless of the season.

18. The method of claim 14 wherein freeze-thaw cycles occuring due to fluctuations in operation are significantly dampened.

19. A buried pipeline system for transporting refrigerated fluids through frost-susceptible soil which comprises:

(a) a pipeline; and (b) a plurality of heat pipes buried substantially along the axis of said pipeline and in the soil beneath said pipeline such that a temperature differential will exist between said pipeline and the soil surrounding a lower portion of each of said heat pipes during pipeline operation, whereby said heat pipes operate to passively extract heat from and freeze the soil due to said temperature differential without substantial ice lense formation tending to deform said pipeline.

* * * * *